US007992393B2

(12) United States Patent
Newman

(10) Patent No.: US 7,992,393 B2
(45) Date of Patent: Aug. 9, 2011

(54) COOLING OR FREEZING APPARATUS USING HIGH HEAT TRANSFER NOZZLE

(75) Inventor: Michael D. Newman, Hillsborough, NJ (US)

(73) Assignee: Linde Aktiengesellschaft (DE)

( * ) Notice: Subject to any disclaimer, the term of this patent is extended or adjusted under 35 U.S.C. 154(b) by 486 days.

(21) Appl. No.: 12/346,435

(22) Filed: Dec. 30, 2008

(65) Prior Publication Data

US 2010/0162732 A1 Jul. 1, 2010

(51) Int. Cl.
*F17C 7/02* (2006.01)

(52) U.S. Cl. ..... 62/52.1; 62/380

(58) Field of Classification Search ..... 62/62, 52.1, 62/63, 320, 346, 426, 500, 515; 417/165, 417/167, 168, 169, 179, 180; 165/908
See application file for complete search history.

(56) References Cited

U.S. PATENT DOCUMENTS

| | | | | | |
|---|---|---|---|---|---|
| 3,694,107 | A * | 9/1972 | Stein | 417/167 | |
| 3,763,672 | A * | 10/1973 | Bahnsen | 68/205 R | |
| 3,871,185 | A * | 3/1975 | Harper et al. | 62/63 | |
| 3,871,190 | A * | 3/1975 | Harper et al. | 62/380 | |
| 3,914,953 | A * | 10/1975 | Miller | 62/266 | |
| 4,397,158 | A * | 8/1983 | Brenik et al. | 62/380 | |
| 4,451,002 | A * | 5/1984 | Klee et al. | 236/101 R | |
| 4,524,548 | A * | 6/1985 | Klee et al. | 451/53 | |
| 4,552,566 | A * | 11/1985 | Kita et al. | 23/313 R | |
| 4,777,733 | A * | 10/1988 | Usuiwa et al. | 34/429 | |
| 4,856,285 | A | 8/1989 | Acharya et al. | | |
| 5,025,633 | A | 6/1991 | Furmanek | | |
| 5,186,008 | A | 2/1993 | Appolonia et al. | | |
| 5,218,826 | A | 6/1993 | Kirschner et al. | | |
| 5,267,449 | A | 12/1993 | Kiczek et al. | | |
| 5,399,203 | A * | 3/1995 | Ishikawa et al. | 134/10 | |
| 5,467,612 | A * | 11/1995 | Venetucci | 62/374 | |
| 5,683,033 | A | 11/1997 | Thayer | | |
| 5,863,338 | A * | 1/1999 | Yamada et al. | 118/719 | |
| 6,073,864 | A * | 6/2000 | Berghoff et al. | 239/573 | |
| 6,167,708 | B1 * | 1/2001 | Cloarec | 62/63 | |
| 6,176,102 | B1 | 1/2001 | Novak et al. | | |
| 6,557,367 | B1 | 5/2003 | Lang et al. | | |
| 6,877,327 | B2 | 4/2005 | Newman et al. | | |
| 7,258,226 | B2 | 8/2007 | Nelson et al. | | |
| 2004/0101435 | A1 * | 5/2004 | Centanni et al. | 422/22 | |

OTHER PUBLICATIONS

Ronald D. Flack, University of Virginia, Fundamentals of Jet Propulsion with Applications, Cambridge Aerospace Series, Jun. 2005, Title Page, pp. 3-11, Cambridge University Press.

C. J. Clark, B. Carswell, Principles of Astrophysical Fluid Dynamics, 2007, pp. 78-82, Chpt 9.2, 1st Edition, Cambridge University Press.

George P. Sutton, Rocket Propulsion Elements: An Introduction to the Engineering of Rockets, 1992, 17 pp., 6th Edition, Wiley-Interscience.

* cited by examiner

*Primary Examiner* — Mohammad Ali
(74) *Attorney, Agent, or Firm* — Joshua L. Cohen

(57) ABSTRACT

An apparatus for reducing temperature of items includes an enclosure having an inlet and an outlet for the items within the enclosure; a conveyor for conveying the items within the enclosure from the inlet to the outlet; one or more delivery nozzles positioned to deliver gaseous cryogen and liquid or solid cryogen at supersonic velocity to the items on the conveyor. The apparatus delivers supersonic gaseous cryogen and fine liquid cryogen droplets onto the surface of food items to cool or freeze the food items.

20 Claims, 2 Drawing Sheets

COOLING OR FREEZING APPARATUS USING HIGH HEAT TRANSFER NOZZLE

BACKGROUND

Methods are available to cryogenically freeze food items. Some of the benefits of cryogenic cooling and freezing include short cooling/freezing times, inhibition of microbiological activity and improved food quality due to decreased ice crystal formation and dehydration. The most common methods for cryogenic freezing involve spraying the surface of the food items with nitrogen ($N_2$) or carbon dioxide ($CO_2$). In $N_2$ systems, liquid $N_2$ is typically sprayed into the freezer were it contacts the food items. As droplets touch the food item, the liquid changes to a vapor, extracting heat from the food surface in the process. The vapor distributed within the freezer can also be driven by convective currents to increase the freezing or cooling rate. Typically, about half of the cooling effect is provided by the $N_2$ phase change from liquid to vapor.

Different types of cryogenic freezers are available. These include immersion freezers, tunnel and spiral freezers, and impingement freezers. Immersion freezers immerse the food item in a liquid bath, which rapidly freezes the item and forms a "crust" on the product which reduces the dehydration rate and clumping of the food item. This method leads to significant thermal shock and is thus not suitable for delicate food items. Tunnel freezers transport the product through the freezer where a liquid cryogenic substance is sprayed onto the product. Spiral freezers are similar, except that they use a vertical axis spiral belt rather than a straight belt to convey the food items, and therefore require less space on a production floor. Cryogenic impingement freezers use high velocity air jets driven onto the food item to freeze or cool the food items and decrease the boundary layer resistance to heat transfer, providing a relatively higher rate of heat transfer. However, conventional impingement jets only reach maximum velocities of about 20 meters per second. Cryogenic impingement freezers typically lead to higher production rates, but have a higher capital cost.

DETAILED DESCRIPTION

Figure 1:
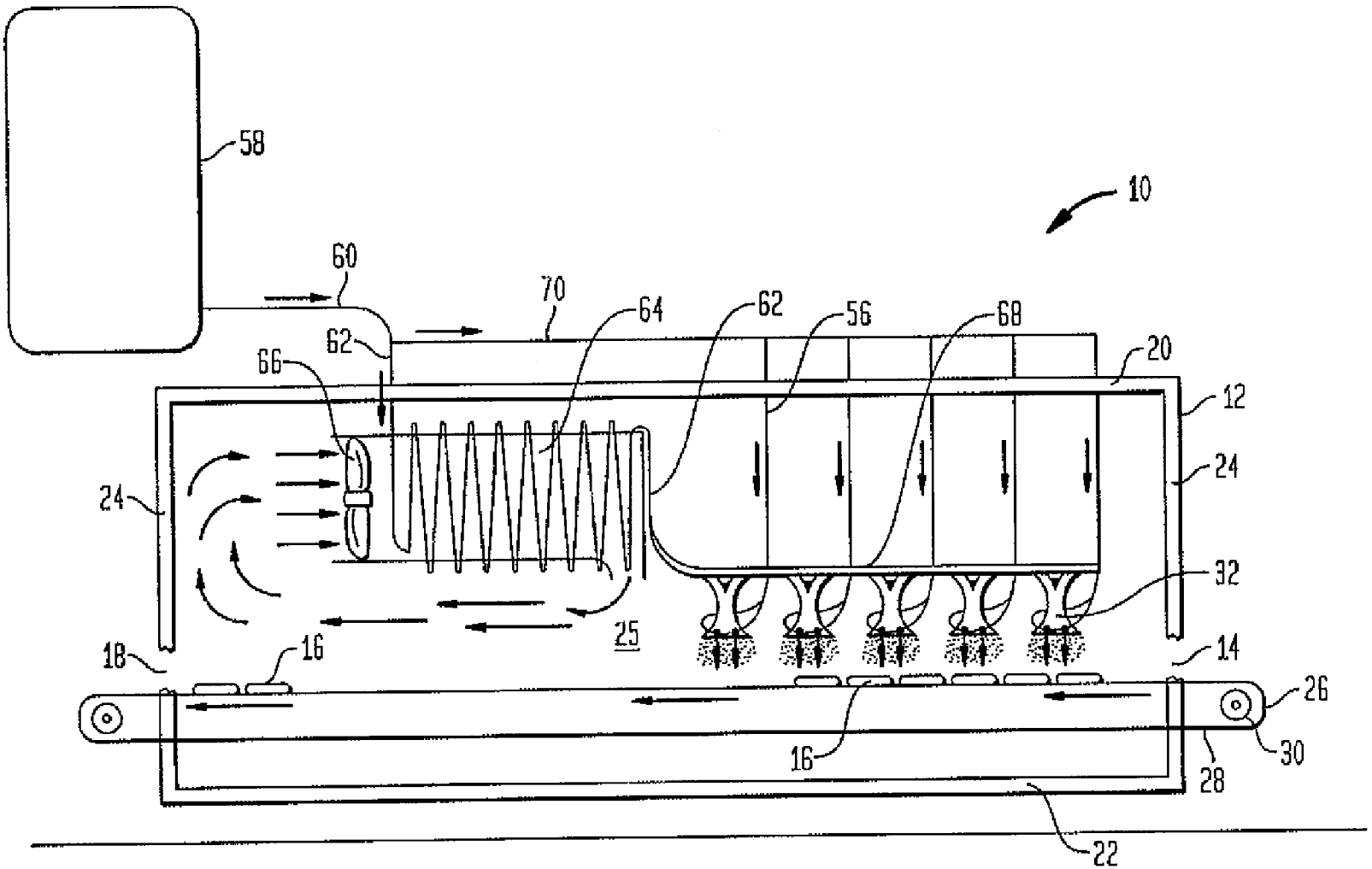
FIG. 1 is a schematic cross-sectional side view of an embodiment of a freezer apparatus.

An apparatus is provided for cooling or freezing items and includes an enclosure having an entrance for receiving the items and an exit for the items; a conveyor that conveys the items within the enclosure from the entrance to the exit; at least one supersonic delivery nozzle positioned to deliver both liquid or solid and gaseous cryogen to the items on the conveyor; at least one first conduit for providing gaseous cryogen to the at least one supersonic delivery nozzle; and, at least one second conduit for providing liquid cryogen to the at least one supersonic delivery nozzle.

In certain embodiments, an apparatus for cooling or freezing food items includes an enclosure having an entrance for receiving the food items and an exit for the items; a conveyor that conveys the food items within the enclosure from the entrance to the exit; an array of supersonic delivery nozzles positioned to deliver both liquid or solid and gaseous cryogen to the food items on the conveyor; wherein the supersonic delivery nozzles each comprise a casing which bounds a flowpath for the gaseous cryogen extending axially through the nozzle, the casing comprising a convergent region upstream of a throat and a divergent region extending downstream from the throat, and at least one secondary nozzle positioned at the exit of, or within the divergent region of the casing to deliver liquid or solid cryogen into the gaseous cryogen flowing from or within the at least one supersonic delivery nozzle; at least one first conduit for providing gaseous cryogen to the supersonic delivery nozzles; and, at least one second conduit for providing liquid cryogen to the at least one secondary nozzle.

The apparatus may further include a blower for circulating gaseous cryogen within the enclosure; and, a heat exchanger in communication with the at least one first conduit, adapted to receive liquid cryogen, wherein the liquid cryogen within the heat exchanger is warmed and gasified by spent gaseous cryogen circulated by the blower external to the heat exchangers whereby the heat exchanger provides fresh gaseous cryogen to the at least first conduit and the at least one supersonic delivery nozzle.

A method for cooling or freezing food items is also provided which includes introducing food items onto the conveyor of the apparatus described above, providing liquid cryogen to the heat exchanger and to the at least one secondary nozzle via the at least one second conduit; converting the liquid cryogen in the heat exchanger to gaseous cryogen, and providing the gaseous cryogen to the supersonic delivery nozzles via the at least one first conduit; accelerating the gaseous cryogen to supersonic speeds in the supersonic delivery nozzles; mixing liquid or solid cryogen from the at least one secondary nozzle with the supersonic gaseous cryogen to form fine liquid cryogen droplets or cryogen snow; and delivering the supersonic gaseous cryogen and fine liquid cryogen droplets or cryogen snow to the surface of the food items to cool or freeze the food items.

The present apparatus increases the heat transfer which can be achieved over conventional cryogenic injection systems. Embodiments of the apparatus increase the heat transfer obtained in several different ways. For example, higher overall gas velocities can be provided which yield increased convective heat transfer. Embodiments also provide conversion of the potential energy of stored cryogenic gas into high velocity, Kith a significant reduction in gas temperature which results in more cooling efficiency. In addition, smaller cryogen droplet sizes can increase evaporative cooling and lead to higher heat transfer rates on the surface of the food items being cooled or frozen.

Referring to FIG. 1, an exemplary embodiment of an apparatus for cooling or freezing for example food items 16 is shown generally at 10. The apparatus 10 includes a freezer enclosure 12 having an entrance 14 for receiving the food items 16 and an exit 18 for the food items 16. Embodiments of the freezer enclosure 12 can have a top wall 20, a bottom wall 22, and four side walls 24 (only two of which are shows due to the perspective of the FIG. 1). The entrance 14 and the exit 18 can be conventional gates to permit the food items 16 to enter and leave the freezer enclosure 12. The entrance 14 and the exit 18 are provided in opposite side walls 24 in many embodiments of the apparatus, but may also be placed in other arrangements for the enclosure 12. The freezer enclosure 12 includes sufficient internal space in the form of a chamber 25 for the passage of the food items 16 therethrough and the various devices used to convey, cool and/or freeze the food items 16. The walls 20, 22, 24 of the apparatus 10 can be lined with thermal insulation in order to reduce heat transfer between an interior of the freezer enclosure 12 and the external environment.

The apparatus 10 includes a conveyor shown generally at 26 that conveys the food items 16 from the entrance 14 through the chamber 25 and to the exit 18. The conveyor 26 can be, for example, a belt conveyor. The conveyor may include a belt 28 that is made of a flexible material capable of supporting the food items 16 and having a low heat capacity. The belt 28 may travel on a revolving path over rollers 30 provided at opposing ends of the conveyor 26 near the entrance 14 and the exit 18. Suitable conveyors usable in freezer enclosures 12 are known A plurality of the conveyors 26 can be used if, for example, the food items 16 travel through a more circuitous path in the chamber 25. The conveyors 26 may be other than a belt conveyor, such as a series of rollers used to move the food items 16 through the freezer enclosure 12.

The configuration of the apparatus 10 can vary. For example, the apparatus 10 may have a configuration as a "tunnel freezer", in which the apparatus 10 has a pair of long, rectangular sides and the food items 16 travel down a length of the apparatus 10 along the chamber 25. Another configuration is the "spiral freezer".

The apparatus 10 also includes one or a plurality of supersonic delivery nozzles 32 positioned to deliver both gaseous and at least one of liquid or solid cryogen (hereinafter "mixed phase cryogen") to the food items 16. For example, the supersonic delivery nozzles 32 may be positioned in the chamber 25 above the food conveyor 26 to deliver the mixed phase cryogen onto food items being conveyed through the chamber 25 by the conveyor 26, as shown in FIG. 1. In certain embodiments, the exit of the supersonic delivery nozzles 32 may be from about 3 inches to about 24 inches above the product. One or a plurality of supersonic delivery nozzles 32 may be used. Where a plurality of supersonic delivery nozzles 32 is used, they may be positioned in an array whose arrangement optimizes the delivery of cryogen to the food items 16 to provide a high overall heat transfer rate.

The supersonic delivery nozzles 32 (the "nozzles") deliver both gaseous and at least one of liquid or solid cryogen. As used herein the term "cryogen" includes all cryogenic substances known to those skilled in the art, including nitrogen, helium, argon, and the like. The cryogen should have the property of having both gaseous and liquid or solid forms at suitable temperatures. Nitrogen is the preferred cryogen because of its ready availability and low cost. Liquid cryogen is cryogen that remains in a liquid state, i.e., a fluid that includes loose particles that can freely form a distinct surface at its boundaries. Liquid cryogen includes finely dispersed liquids. Solid cryogen is cryogen that is in a solid phase, such as carbon dioxide snow. Gaseous cryogen is cryogen that is in the gaseous phase which is a state of matter consisting of a collection of particles (e.g. molecules or atoms) without a definite shape or volume that are in more or less random motion. Mixed phase cryogen, with respect to nitrogen, is gaseous and liquid nitrogen. With respect to carbon dioxide, mixed phase cryogen is gaseous and solid carbon dioxide.

The apparatus 10 includes supersonic delivery nozzles 32, also known as supersonic convergent-divergent nozzles. The nozzles 32 are used as a means of accelerating the flow of a gas passing through them to a supersonic speed. Their operation relies on the different properties of gases flowing at subsonic and supersonic speeds. The speed of a subsonic flow of gas will increase if the pipe carrying it narrows because the mass flow rate is constant. The gas flow through a supersonic nozzle is isentropic; i.e., the gas entropy is nearly constant. At subsonic flow the gas is compressible. Therefore, sound, which is a small pressure wave, is able to propagate through it. At the "throat", where the cross sectional area is a minimum, the gas velocity locally becomes sonic (Mach number=1.0), a condition called choked flow. As the nozzle cross sectional area increases the gas continues to expand and the gas flow increases to supersonic velocities where a sound wave cannot propagate backwards through the gas as viewed in the frame of reference of the nozzle (Mach number>1.0). The design principles of supersonic convergent-divergent nozzles are well known in the art of aeronautical science. U.S. Pat. No. 5,683,033, the disclosure of which is incorporated by reference herein, describes supersonic convergent-divergent nozzles suitable for use with a rocket engine. The nozzles 32 will typically have a circular circumference throughout the length of the nozzle.

Figure 2:
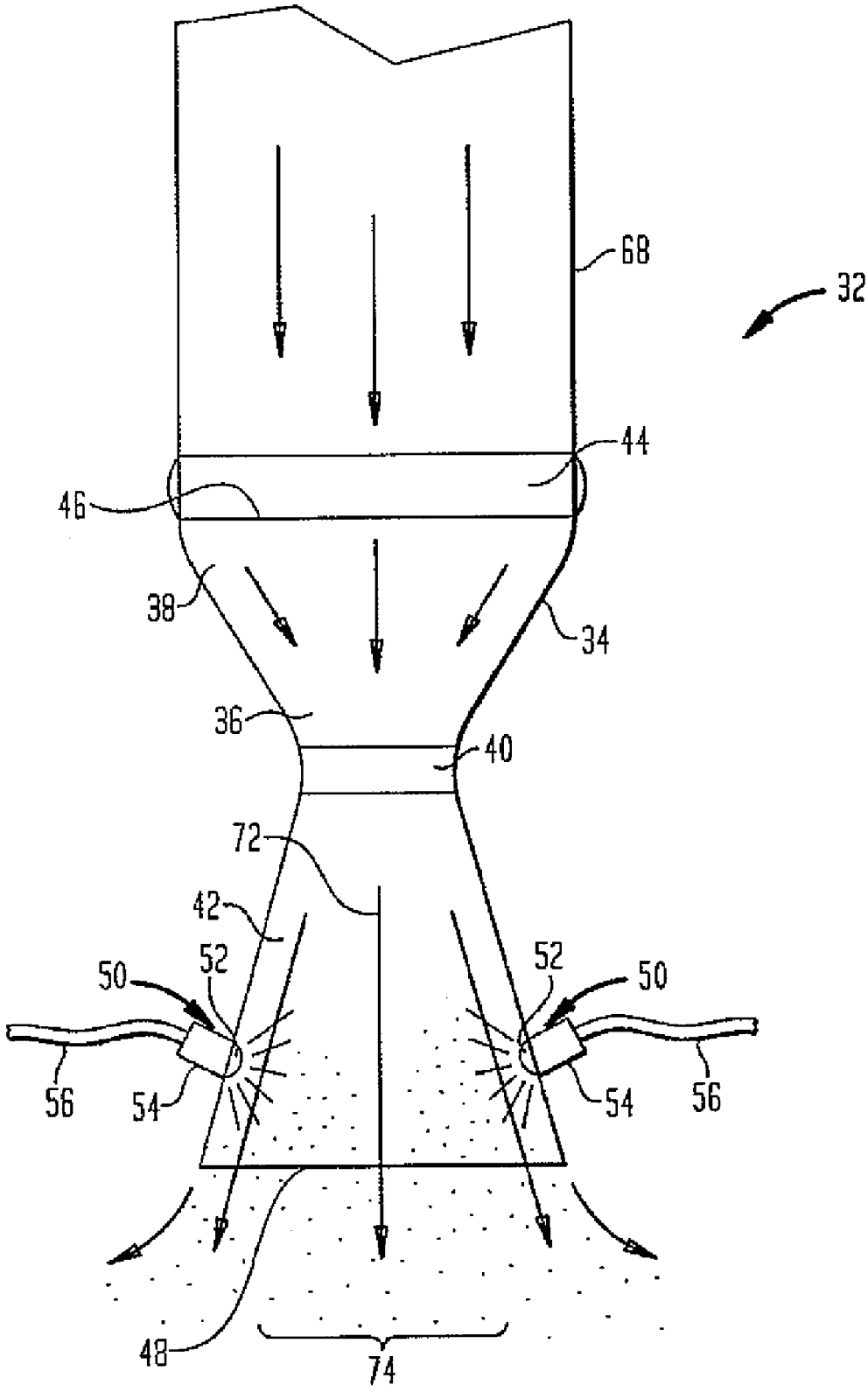
FIG. 2 is a schematic cross-sectional side view of an embodiment of a supersonic delivery nozzle which may be used in the apparatus of FIG. 1.

A cross-sectional side view of an embodiment of the nozzles 32 for use in the apparatus 10 is provided in FIG. 2. The nozzle 32 includes a casing 34 or housing which defines a flowpath 36 through the casing 34 for gaseous cryogen and extending axially through the nozzle 32. The nozzle 32 can be formed from a variety of materials suitable for handling high velocity gaseous cryogen, such as stainless steel, aluminum, copper, copper-nickel alloys, and plastics such as ultra high molecular weight (UHMW) plastic or TEFLON® polytetrafluoroethylene (DuPont, Wilmington Del.). The diameter of the nozzle may range from about 0.25 inches up to about 3 inches and lengths of the nozzle may vary from about 2 inches up to about 12 inches.

The casing 34 includes a convergent region 38 positioned upstream of a throat 40 and a divergent region 42 extending downstream from the throat 40. The convergent region 38 is that portion of the nozzle 32 that narrows (i.e. converges) towards the region with the smallest diameter provided by the throat 40. Gaseous cryogen is provided to the convergent region 38 of the nozzle 32 from a cryogen injection manifold 68 connected by a connector 44 which interconnects a connecting end 46 of the convergent region 38, which is the end distal from the throat 40 with the manifold 68. The gaseous cryogen flows through the convergent region 38 of the nozzle 32 at subsonic speeds during operation of the nozzle 32.

The throat 40 is disposed between the convergent region 38 and the divergent region 42. As gas velocity increases from the nozzle throat 40, the temperature and the pressure of the gas decrease. In certain embodiments, the throat 40 is the region of the nozzle 32 through which the gaseous cryogen flows at about Mach 1 (the speed of sound) during operation of the nozzle 32. Embodiments of the apparatus 10 include nozzles 32 in which the throat 40 has a diameter which may be a ratio in the range of from about 1:1.1 to about 1:1.8 relative to the connecting end 46 of the convergent region 38.

The divergent region 42 of the nozzle 32 extends from the throat 40 to a discharge opening 48 of the nozzle 32, and is the region of the nozzle 32 through which gaseous cryogen flows at a supersonic speed (i.e. >Mach 1) during operation of the nozzle 32. The divergent region 42 can be configured to provide optimum performance at the ambient pressure during operation of the apparatus 10, which will typically be atmospheric pressure. As is known to those skilled in the art, the nozzle is preferably long enough so that the pressure of air exiting the nozzle is substantially the same as the pressure existing outside the nozzle. Embodiments of the divergent region 42 are cone-shaped, and can have an internal angle cone of about 12 degrees. Other embodiments may use divergent regions 42 having a parabolic rather than a cone shape.

The nozzles 32 include one or a plurality of secondary nozzles 50 positioned proximate the discharge opening 48 of, or within the casing 34, to deliver liquid cryogen into the gaseous cryogen flowing within the nozzle 32 during its operation. In certain embodiments there may be 2 to 4 secondary nozzles disposed on each supersonic nozzle, although a different number of nozzles may be used as well. The secondary nozzles 50 include a nozzle outlet 52 positioned at an interior of the divergent region 48 and a connector 54 positioned at the nozzle 32. The connector 54 connects the secondary nozzle 50 to a cryogen line 56 or conduit that delivers liquid cryogen to the secondary nozzle 50. The secondary nozzle 50 is suitable for delivering a cryogenic liquid, preferably as a spray, and are commercially available in a variety of designs such as v-jet and full cone spray nozzles from Spraying Systems Co. (Wheaton, Ill.) and BETE Fog Nozzle, Inc. (Greenfield, Mass.). The secondary nozzles 50 can be positioned anywhere within the nozzle 32. In some embodiments, the nozzles 50 may be placed only within the divergent region 42 of the nozzle. In further embodiments, the secondary nozzles 50 may be positioned adjacent to the discharge opening 48 where they deliver liquid cryogen at a point where the gaseous cryogen stream 72 is exiting the nozzle 32.

The apparatus 10 also includes means for providing liquid and gaseous cryogen to the supersonic delivery nozzles 32. An embodiment of such means, referred to herein as a "delivery system," is shown in FIG. 1. Liquid cryogen from a bulk storage tank 58 at a pressure of about 30 to about 100 psig is delivered to the freezer enclosure 12 through a conduit or pipeline 60 that branches off with appropriate valves into two separate distribution conduits 62, 70 or pipelines.

The first of these is the cryogen gas line 62. In the cryogen gas line 62, the liquid cryogen (e.g. nitrogen at about 30 to about 100 psig and about −320° F.) enters a nitrogen heat exchanger 64. The heat exchanger 64 may be a portion of the cryogen gas line 62 which is arranged as a coil to provide greater surface area for heat exchange. As the liquid cryogen flows through the heat exchanger 64, one or a plurality of circulation fans 66 blow N relatively warm gas (which has taken up heat from the food product) across cryogen gas line 62 as it passes through the heat exchanger 64. The relatively warm gas contacting the heat exchanger 64 may include spent cryogen gas that has absorbed heat from the food items 16 on the conveyor 26 after having been delivered from the nozzles 32 and may also include recycled gas that has already passed over the heat exchanger 64. Heat is transferred from the blown gas to the liquid cryogen flowing through the heat exchanger 64, causing the liquid cryogen within the heat exchanger to experience a phase change from liquid to gas. For example, if the liquid cryogen being used is nitrogen gas, it can exit the heat exchanger 64 as a gas at about 30 to about 100 psig and about −60° F. This now gaseous cryogen is fed along the cryogen gas line 62 into the cryogen injection manifold 68 that is in communication with and may feed an arrays of the nozzles 32. Alternatively, it one of the nozzles 32 is used, the cryogen gas line 62 may feed directly to that nozzle 32. Gas enters each of the nozzles 32 at subsonic velocity and then exits the nozzle at a supersonic velocity and a colder temperature (e.g. −190° F. for nitrogen).

In the second distribution pipeline. i.e. the secondary liquid cryogen pipeline 70, cryogen (e.g., nitrogen at about 30 to about 100 psig and −320° F.) still in its liquid state is provided into the 50 positioned, in certain embodiments, within the casing 34 of the supersonic delivery nozzles 32 (e.g., in the discharge area of each supersonic deliver nozzle 32). Upon entering the nozzle 32, the liquid cryogen is atomized and entrained in the gaseous cryogen stream 72 flowing through the nozzle 32. The supersonic gas flow will break-up the liquid particles into extremely fine droplets 74 which are helpful for increasing evaporative heat transfer. The now combined supersonic flow with atomized droplets 74 of liquid cryogen is then brought into contact with the food items 16 passing under the supersonic delivery nozzles 32 on the food conveyor 26.

In other embodiments, as the high velocity gaseous cryogenic stream 72 exits the supersonic delivery nozzle 32, at least one secondary liquid nozzle 50 will be positioned just outside the exit and will inject cryogenic liquid into the gaseous cryogenic stream 72. The supersonic gas flow breaks the liquid particles into extremely fine droplets 74 for enhanced evaporative heat transfer, to cause both the cryogenic liquid droplets 74 and high velocity gaseous cryogenic stream 72 to impinge the food items 16 on the conveyor 26.

As the mixed phase cryogen flow impinges the surface of the food items 16, in certain embodiments substantially immediately after exiting the delivery nozzle 32, both convective and evaporative heat transfer combine and result in surface heat transfer rates higher than that realized in conventional cryogenic injection systems. For example, the heat transfer rates can be 10-20 times higher than that realized in conventional cryogenic injection systems.

In the embodiment shown in FIG. 1, an array of nozzles accelerates the velocity of pressured cryogenic gas. In some embodiments, this apparatus can be used to accelerate the cryogen gas exiting the nozzles 32 to greater than Mach 1.5 and in excess of 350 meters per second. As the gaseous cryogen is passed through the nozzles 32 it will decrease in temperature (e.g. by 150° F. or more) and increase in velocity. Lower temperature and high velocity are both significantly beneficial for maximizing heat transfer from the food items 16.

If liquid carbon dioxide is utilized as the cryogen and delivered by the liquid cryogen pipeline 70, the liquid carbon dioxide will flash upon delivery from the secondary nozzles 50 into the supersonic delivery nozzle 32, to form carbon dioxide gas and solid carbon dioxide snow. The supersonic flow of gaseous carbon dioxide gas and carbon dioxide snow as the mixed phase cryogen contacts the food items to enhance heat transfer.

High heat transfer coefficients are achieved with the subject apparatus and method embodiments, which lead to increases in overall freezer efficiency and/or reduction in size of equipment. The apparatus and method utilize the potential energy of the stored cryogenic gas in an isentropic process, wherein high pressure, high temperature gas is converted to a high velocity, low temperature gas flow stream. The decrease in gas temperature (in excess of −150° F.) may increase the overall system efficiency by as much as 12%.

It will be understood that the embodiments described herein are merely exemplary, and that one skilled in the art may make variations and modifications without departing from the spirit and scope of the invention. All such variations and modifications are intended to be included within the scope of the invention as described and claimed herein. Further, all embodiments disclosed are not necessarily in the alternative, as various embodiments of the invention may be combined to provide the desired result.

What is claimed is:

1. An apparatus for reducing temperature of items, comprising:

an enclosure having an inlet and an outlet for the items within the enclosure;

a conveyor for conveying the items within the enclosure from the inlet to the outlet;

at least one delivery nozzle positioned to deliver mixed phase cryogen at supersonic velocity to the items on the conveyor;

at least one first conduit for providing gaseous cryogen to the at least one delivery nozzle; and at least one second conduit for providing liquid cryogen to the at least one delivery nozzle.

2. The apparatus of claim 1, wherein the at least one delivery nozzle comprises a casing having a towpath therethrough extending axially through the at least one delivery nozzle for the gaseous cryogen, the casing comprising a throat, a convergent region upstream from the throat and a divergent region downstream from the throat, and at least one secondary nozzle in communication with the at least one second conduit, the secondary nozzle positioned proximate a discharge opening of, or within the casing to deliver the liquid cryogen or solid cryogen flashing from the liquid cryogen into the gaseous cryogen flowing from or within the at least one delivery nozzle.

3. The apparatus of claim 2, wherein the at least one secondary nozzle is positioned to deliver the liquid or solid cryogen to the divergent region of the at least one delivery nozzle.

4. The apparatus of claim 2, wherein a plurality of the at least one delivery nozzles are disposed in an array to deliver mixed phase cryogen to the items on the conveyor.

5. The apparatus of claim 4, further comprising a blower for circulating gaseous cryogen within the enclosure.

6. The apparatus of claim 5, further comprising a heat exchanger in communication with the at least one first conduit, the heat exchanger adapted to receive liquid cryogen, wherein the liquid cryogen within the heat exchanger is warmed and gasified by spent gaseous cryogen circulated by the blower external to the heat exchanger, whereby the heat exchanger provides fresh gaseous cryogen to the at least one first conduit downstream from the heat exchanger and to the at least one delivery nozzle.

7. The apparatus of claim 6, further comprising a liquid cryogen source for supplying liquid cryogen to the at least one second conduit and to the heat exchanger.

8. The apparatus of claim 1, wherein the at least one delivery nozzle is adapted to deliver liquid and gaseous nitrogen cryogen.

9. The apparatus of claim 1, wherein the at least one delivery nozzle is adapted to deliver solid and gaseous carbon dioxide cryogen.

10. The apparatus of claim 1, wherein a plurality of the at least one delivery nozzle is disposed in an array to deliver mixed phase cryogen to the items on the conveyor.

11. The apparatus of claim 1, further comprising a blower for circulating gaseous cryogen within the enclosure.

12. The apparatus of claim 11, further comprising a heat exchanger in communication with the at least one first conduit, the heat exchanger adapted to receive liquid cryogen, wherein the liquid cryogen within the heat exchanger is warmed and gasified by spent gaseous cryogen circulated by the blower external to the heat exchanger, whereby the heat exchanger provides flesh gaseous cryogen to the at least one first conduit downstream from the heat exchanger and to the at least one delivery nozzle.

13. A method for reducing the temperature of items, comprising:

introducing the items onto a conveyor;

providing gaseous cryogen to at least one delivery nozzle positioned to deliver mixed phase cryogen to the items on the conveyor;

accelerating the gaseous cryogen to supersonic velocity in the at least one delivery nozzle;

providing liquid cryogen to at least one secondary nozzle disposed proximate the discharge opening of or within the at least one delivery nozzle casing;

mixing the liquid cryogen from the at least one secondary nozzle with the gaseous cryogen to form fine liquid cryogen droplets or cryogen snow; and delivering the supersonic gaseous cryogen and fine liquid cryogen droplets or cryogen snow as a mixed phase cryogen at supersonic velocity to the surface of the food items to reduce the temperature of the food items.

14. The method of claim 13, wherein the cryogen is nitrogen.

15. The method of claim 13 wherein the cryogen is carbon dioxide.

16. The method of claim 13, wherein the supersonic velocity is at least 350 meters per second.

17. The method of claim 13, wherein the gaseous cryogen is delivered in the mixed phase cryogen at a temperature of −190° F. or less.

18. A nozzle delivery system, comprising:

at least one delivery nozzle comprising a casing, having a towpath therethrough extending axially through the at least one delivery nozzle for gaseous cryogen, the casing comprising a throat, a convergent region upstream from the throat and a divergent region downstream from the throat;

at least one first conduit for providing the gaseous cryogen to the at least one delivery nozzle;

at least one second conduit for providing liquid cryogen to the at least one delivery nozzle; and at least one secondary nozzle in communication with the at least one second conduit, the secondary nozzle positioned proximate a discharge opening of, or within the casing and adapted to deliver liquid cryogen or solid cryogen flashing from the liquid cryogen into the gaseous cryogen flowing from or within the at least one delivery nozzle.

19. The nozzle delivery system of claim 18, further comprising a heat exchanger in communication with the at least one first conduit, the heat exchanger adapted to receive the liquid cryogen, wherein the liquid cryogen within the heat exchanger is warmed and gasified by spent gaseous cryogen external to the heat exchanger, whereby the heat exchanger provides fresh gaseous cryogen to the at least one first conduit downstream from the heat exchanger and to the at least one delivery nozzle.

20. The nozzle delivery system of claim 18, wherein a plurality of the at least one delivery nozzle is disposed in an array to deliver mixed phase cryogen.

* * * * *

UNITED STATES PATENT AND TRADEMARK OFFICE

CERTIFICATE OF CORRECTION

PATENT NO. : 7,992,393 B2
APPLICATION NO. : 12/346435
DATED : August 9, 2011
INVENTOR(S) : Newman It is certified that error appears in the above-identified patent and that said Letters Patent is hereby corrected as shown below:

Column 7 - line 9 - delete “towpath” and insert therefore -- flowpath --

Column 8 - line 31 - delete “towpath” and insert therefore -- flowpath --

Signed and Sealed this
Thirteenth Day of September, 2011

David J. Kappos

David J. Kappos
*Director of the United States Patent and Trademark Office*